US009279247B2

(12) United States Patent
Maziarz

(10) Patent No.: US 9,279,247 B2
(45) **Date of Patent: *Mar. 8, 2016**

(54) L-BEAD: A LEAK PREVENTION SYSTEM FOR STUCCO SURFACES

(71) Applicant: Jeffrey Maziarz, Royersford, PA (US)

(72) Inventor: Jeffrey Maziarz, Royersford, PA (US)

(73) Assignee: E-Z BEAD, LLC, Royersford, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/275,757

(22) Filed: May 12, 2014

(65) Prior Publication Data

US 2014/0245677 A1 Sep. 4, 2014

Related U.S. Application Data

(63) Continuation of application No. 12/152,046, filed on May 12, 2008, now abandoned.

(51) Int. Cl.
*E04F 13/04* (2006.01)
*E04F 13/06* (2006.01)
(Continued)

(52) U.S. Cl.
CPC ..... *E04B 1/66* (2013.01); *E04F 13/045* (2013.01); *E04F 17/08* (2013.01); *E06B 1/04* (2013.01); *E06B 1/62* (2013.01); *E04F 19/02* (2013.01); *E06B 7/22* (2013.01); *E06B 7/23* (2013.01); *E06B 2001/624* (2013.01)

(58) Field of Classification Search
CPC ..... E04B 1/66; E04B 17/08; E04B 13/45; E04B 13/00; E04B 13/07; E04B 13/072; E04B 19/02; E04B 21/165; E04B 21/1655; E04B 13/06; E04B 13/04; E06B 1/62; E06B 2001/624; E06B 1/04; E06B 7/22; E06B 7/23
USPC ..... 52/256.257, 287.1, 214, 273, 254, 52/288.1, 717.01, 718.06, 717.03, 717.05, 52/211, 204.53
See application file for complete search history.

(56) References Cited

U.S. PATENT DOCUMENTS 3,782,680 A * 1/1974 Hopkins ..... 249/188
4,663,883 A * 5/1987 Hilliard et al. ..... 47/33
5,791,116 A * 8/1998 Skintzis ..... 52/741.4

*Primary Examiner* — Phi A
(74) *Attorney, Agent, or Firm* — Hayes Soloway, P.C.

(57) ABSTRACT

A stop bead for mounting along a frame or jamb of a window or door of a building to separate the frame or jamb from plaster or stucco material during application of the plaster or stucco material to the building comprises a first side end portion and a second side end portion, the first side portion having a leading edge for engaging the frame or jamb when the stop bead is mounted adjacent to the frame or jamb, a base panel having a front face, a stop bead wall formed on the base panel and extending outwardly above the front face of the base panel, the stop bead wall having an engaging surface for engaging plaster or stucco and a frame/jamb facing surface that faces the frame or jamb when the stop bead is mounted adjacent to the frame or jamb, and a spacing member formed on the stop bead and extending outwardly away from the frame/jamb facing surface of the stop bead wall for spacing the stop bead wall a predetermined distance from the frame or jamb when the stop bead is mounted adjacent to the frame or jamb, the spacing member forming the leading edge of the first side portion of the stop bead and forming gap between the stop bead wall and the frame or jamb when the stop bead is mounted adjacent to the frame or jamb for receiving caulk for sealing between the stop bead and the frame or jamb. In a preferred embodiment, the spacing member is flexible to permit movement of the spacing member responsive to movement to weather induced movement of the jamb after the stop bead is mounted adjacent to the jamb.

25 Claims, 5 Drawing Sheets

(51) Int. Cl.

| | | | |
|---|---|---|---|
| ***E04B 1/66*** | (2006.01) | ***E06B 1/04*** | (2006.01) |
| ***E04F 17/08*** | (2006.01) | *E04F 19/02* | (2006.01) |
| ***E06B 1/62*** | (2006.01) | *E06B 7/23* | (2006.01) |
| | | *E06B 7/22* | (2006.01) |

L-BEAD: A LEAK PREVENTION SYSTEM FOR STUCCO SURFACES

CROSS REFERENCES TO RELATED APPLICATIONS

This application is a continuation of U.S. patent application Ser. No. 12/152,046. This application also is related to U.S. patent application Ser. No. 11/981,421, which is a divisional application of U.S. patent application Ser. No. 11/259,499, which is a divisional application of U.S. patent application Ser. No. 09/952,920. U.S. patent application Ser. Nos. 12/152,046, 11/259,499, 09/952,920, and 11/981,421 are incorporated herein by reference.

BACKGROUND OF THE INVENTION

1. Field of the Invention

This invention relates to the application of stucco or plaster in homes or other buildings and specifically to the stop system used between the edge of the stucco or plaster surface and the adjoining frame for windows and doors or where stucco or plaster meets any material dissimilar from the stucco or plaster.

2. Background of the Prior Art

Stucco and/or plaster are typically used for both interior and exterior surfaces in home or commercial building construction. Stucco or plaster is routinely applied to a galvanized wire mesh over felt paper which has been attached to underlying plywood or other sheathing material. (See FIG. 1.) In order to provide a smooth edge where the stucco or plaster meets a door or window jamb or frame, plastic stop strips are installed along the desired edge of the stucco or plaster to contain it and provide for an even finish.

The plastic stop often used for this purpose is presented in FIG. 2. The plaster stop generally consists of a perforated plastic strip approximately 2 inches wide with a plastic lip or edge acting to contain the stucco or plaster away from the jamb or frame. The plaster stop is typically installed approximately ¼ inch away from the jamb or frame, leaving a gap between the stop and the backing surface. In order to provide a complete finish, the worker must install a backer rod into the gap and then apply a finishing layer of caulk. This process that is used by some builders to prevent leaks is very time consuming.

This method of stucco installation has often resulted in leaking problems between the stucco or plaster surface and the adjacent jamb, thereby causing significant additional repair costs and frustration to both home owners and construction companies. In addition, the extra time and materials necessary for installation of the backer rod and finishing caulk layer can add considerably to the costs and duration of the construction. The L-Bead eliminates the need for installation of a backer rod—saving considerable time and money—and significantly cuts down on the potential for leaks around windows and doors.

BRIEF SUMMARY OF THE INVENTION

The present invention, L-Bead system, provides a system for quick, efficient and lower cost installation of stucco and or plaster which cuts down on the potential for leaks around windows and doors. The L-Bead is used as a stop between the edge of the stucco or plaster surface and the adjacent jamb or window/door frame. Proper installation of existing plaster stop requires a ¼ inch gap between the stop and the jamb, mandating the installation of a backer rod and supplemental caulking. The L-Bead system eliminates this need by adding an extra plastic strip or "lip" along the edge of existing plaster stop which abuts directly to the jamb, thereby simplifying a smooth finish and minimizing the potential for leaks.

DETAILED DESCRIPTION OF THE INVENTION

Figure 1:
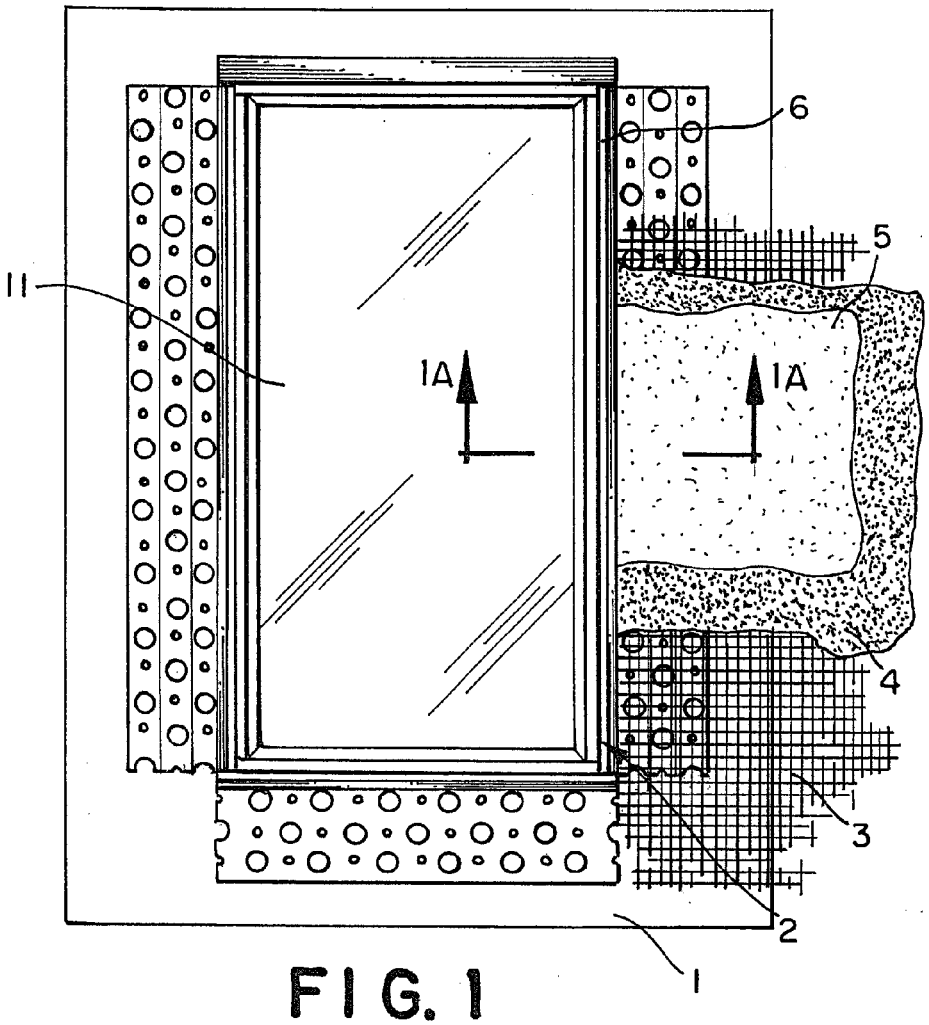
FIG. 1 shows the typical manner in which stucco or plaster will be applied and installed in homes or other buildings around window or door frames or adjacent to other surfaces such as aluminum siding using the L-Bead system. Such construction occurs in layers, with each layer given a number in order of installation. A wire mesh layer of galvanized wire (#3) is anchored over felt paper (#1) to the backing wall (usually plywood or a similar material). Scratch and finish coats of plaster or stucco (#4 and #5) are applied to the wire layer. Where the stucco or plaster meets a window or door jamb or another surface, plastic L-Bead stopping strips (#2) are nailed to the backing wall behind or adjacent to the galvanized wire layer. The edge of the stop closest to the jamb is raised to contain the stucco or plaster and keep it away from the jamb or frame. The key to the L-bead is the separate backing "lip" along the plastic stop which directly abuts the jamb or other surface. No backing rod is necessary. A final small layer of caulk (#6) is applied to finish the job.
Figure 1A:
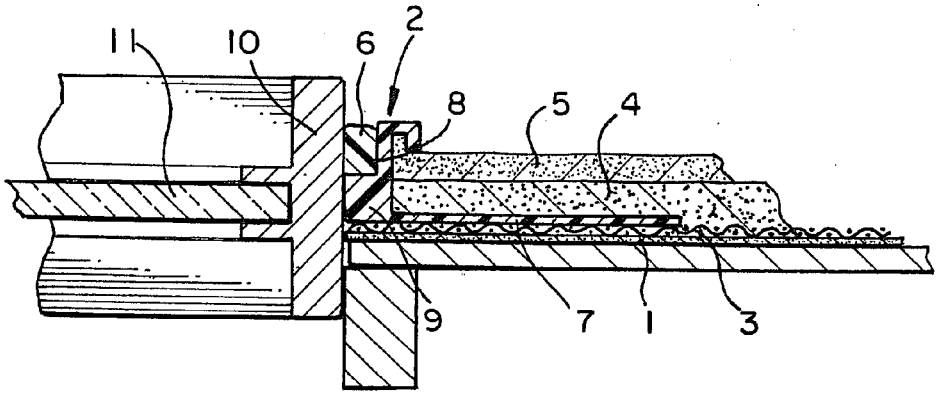
FIG. 1A is a view in cross-section taken along the lines and arrows 1A-1A, illustrating the inventive stop or stop bead 2 mounted along a jamb 10 of a window 11.

The L-Bead system significantly reduces the time and costs necessary to install smooth finishes where stucco or plaster meets window or door frames or jamb. In ordinary house of building construction, exterior and interior surfaces are often made of stucco or plaster. The method of installation of these materials is generally consistent in the construction business and usually involves the installation of a felt layer over the backing wall (plywood or similar material), a galvanized wire (or lathe) layer, and both scratch and finish coats of stucco or plaster. (See FIG. 1.)

Figure 2:
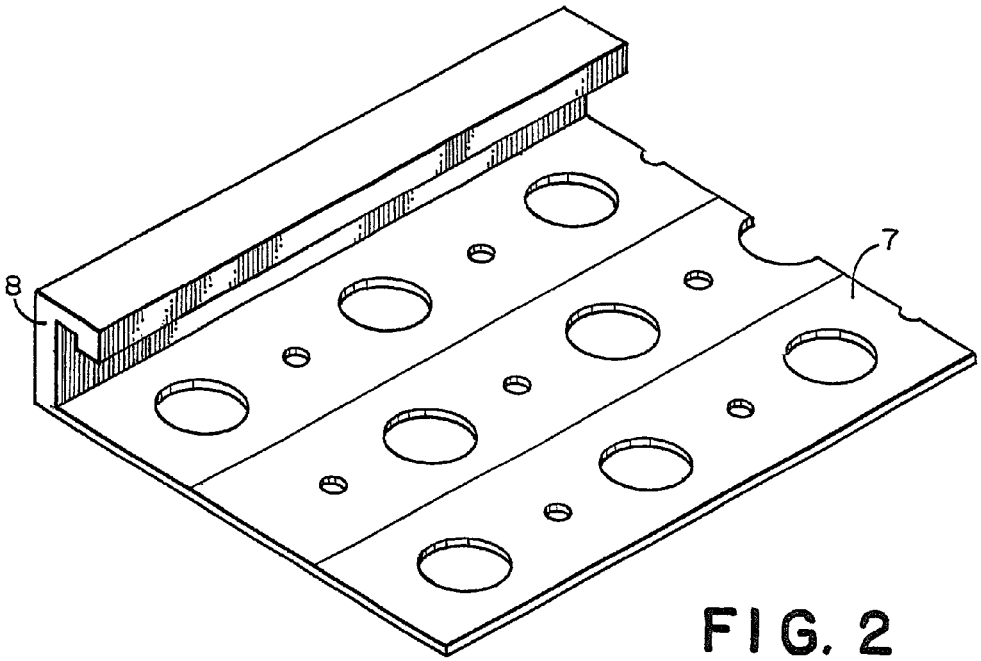
FIG. 2 PRIOR ART
FIG. 2 is a drawing showing an enlarged view of existing plaster stop. The perforated portion of the plaster stop is nailed or otherwise attached to the backing wall. The lip on the edge of the plaster stop acts to contain the plaster or stucco and keep it away from the door or window jamb.

Leaking and other problems often occur where the stucco or plaster finish aligns with other design constructs of the home or building, such as windows or doors. Stop strips which contain and form the outer boundaries of the stucco or plaster surfaces where they meet window or door jambs have been developed to improve the seal and finishes of these adjacencies. In particular, the use of standard plaster stop strips as shown in FIG. 2 has become standard practice in the stucco and masonry business.

However, for traditional plaster stop to be properly installed and finished, the worker typically installs the plaster stop ¼ inch from the edge of the door or window jamb. The resulting gap must be filled with a backing rod and properly caulked for the correct finish. Installation of this backing rod and additional caulking costs time and money, particularly where the architectural design calls for numerous windows, doors or other interruptions in stucco or plaster surfaces. In addition, this manner of construction has unfortunately resulted in frequent leaking problems around windows and doors.

The inventor has come up with a system which eliminates the need for installation of a backing rod by manufacturing an additional strip of plastic which is bound to the existing plaster stop and abuts directly against the jamb or other surface. The L-Bead system significantly modifies both the existing plaster stop unit itself and the ease of installation.

Plaster stop strips routinely consist of a thin, 2-inch wide strip 7 of plastic which is perforated throughout its length and which contains an edge strip 8 of plastic approximately ½ inch high running along one side of the strip 7. The top ¼ inch of this additional plastic strip 8 is then bent back over the wide, perforated portion strip 7 forming a "lip" which runs along the entire length of the stop. See FIG. 2. When the plaster stop strip is nailed to the backing wall, it is installed approximately ¼ inch away from the jamb or other surface. The lip side contains and holds the stucco or plaster in place providing a smooth, straight edge.

Because traditional plaster stop must be installed ¼ inch from the jamb for it to perform properly, there remains a ¼ inch gap running the entire length of the adjacency between the stucco and the door or window jamb. In typical construction, this gap is filled with a backing rod and requires considerable caulking which often leads to leaking or other problems. The L-Bead system eliminates this last step and will greatly improve construction techniques for reducing leaks in windows or doors.

Figure 3:
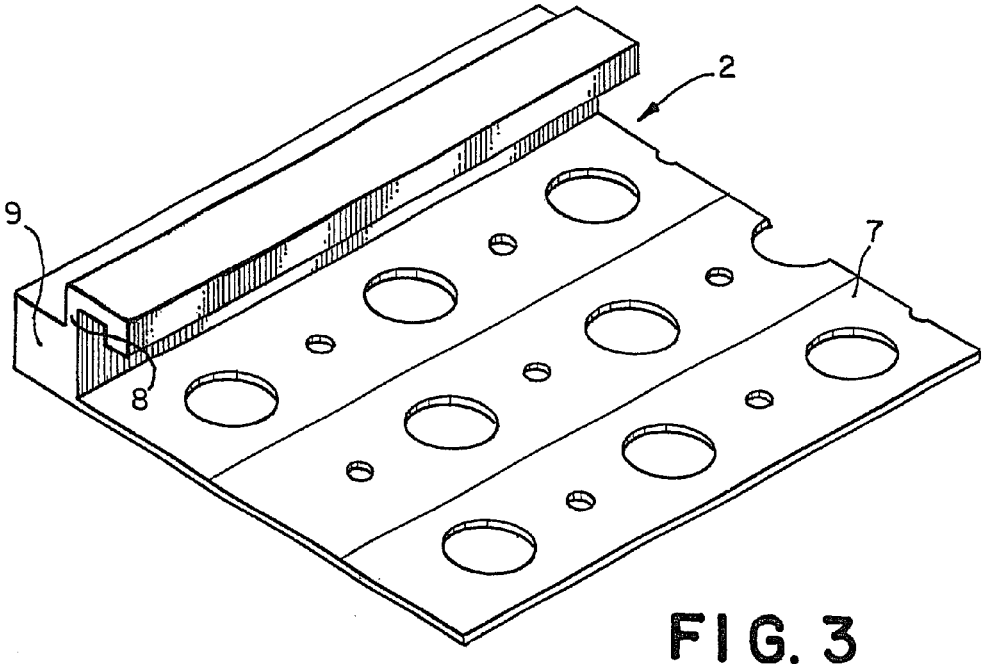
FIG. 3 shows the new L-Bead. As with traditional plaster stop, the perforated portion is nailed or otherwise attached to the backing wall. The higher lip part of the stop contains the stucco or plaster. The added backing lip of the L-Bead abuts directly to the jamb and eliminates the need for a backer rod, thereby cutting down on both leaks and installation time.
Figure 4:
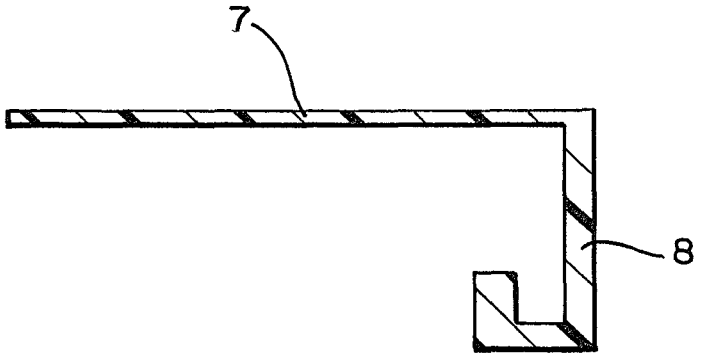
FIG. 4 PRIOR ART
FIG. 4 is a view in cross-section of the prior art stop or stop bead shown in FIG. 2.
Figure 5:
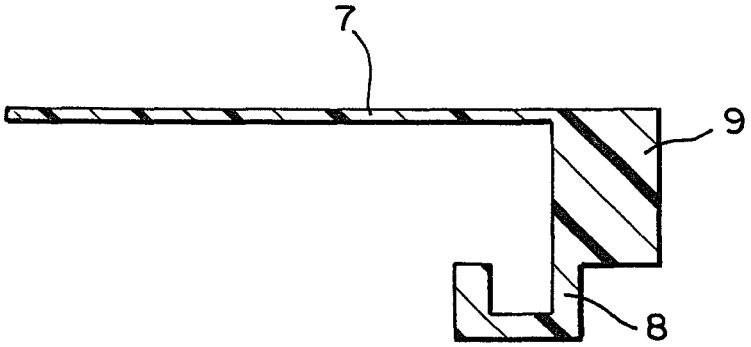
FIG. 5 is a view in cross-section of the inventive stop or stop bead 2 shown in FIG. 3.

The L-Bead system alters traditional plaster stop by adding a separate backing strip 9 to the existing plaster stop. The additional length of plastic stripping 9 is attached to the outside of the lip and runs along the entire length of the stop 2. (See FIG. 3.) Whereas the original plaster stop contained the stucco or plaster, the L-Bead system not only contains the stucco or plaster, but also provides a backing strip 9 which abuts directly against the jamb 10 or other surface and thereby eliminates the need for (and serves the purpose of) a backing rod and additional caulking. Because the additional backing strip 9 is located lower than the lip containing the stucco, it can account for variations in the jamb 10 or other surface. A simple and thin caulking 6 over the L-Bead, where it meets the jamb 10 or other surface, makes for a smooth, leak-proof finish.

The L-Bead system is a system for use as a plaster or stucco stop where the plaster or stucco meets a separate surface such as window or door frames or jamb. Typical plaster stop in the stucco masonry industry consists of a perforated strip running parallel to the jamb with a plastic edge acting to contain the applied plaster or stucco surface. Traditional plaster stop is routinely installed approximately ¼ inch away from the jamb in order to account for differences in the raised height of the jamb or other surface. The resulting gap or space requires the installation of a backer rod between the plaster stop and the edge of the jamb. This requires additional construction costs and can cause considerable potential for leaks.

The L-Bead system provides a stop system which eliminates the need for the installation of a backer rod and thereby reduces the potential for leaks. The L-Bead system adds an additional plastic strip to the back and along the length of the stop. The L-Bead is installed flush against the jamb, eliminating the need for a backer rod, and requiring only a small amount of caulking over the area for a finished job. This new system will save time and money and will significantly reduce the potential for leaks in these areas.

L-Bead eliminates the need for backing rods around windows, doors or any other place where stucco or plaster meets a different surface. Given that a typical house design includes numerous windows, doors, garages, or other architectural interruptions in stucco surfaces, the elimination of backer rods and simplified construction associated with the L-Bead system will save millions of dollars in construction costs and will greatly improve such finishes against leaking or other problems.

Figure 6:
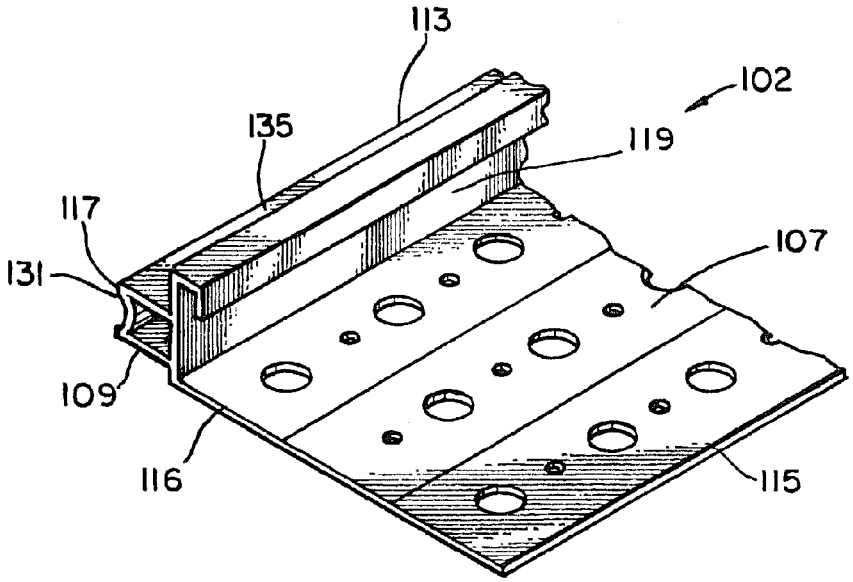
FIG. 6 is a view in perspective showing a preferred alternative embodiment of the inventive stop bead constructed in accordance with the invention.
Figure 7:
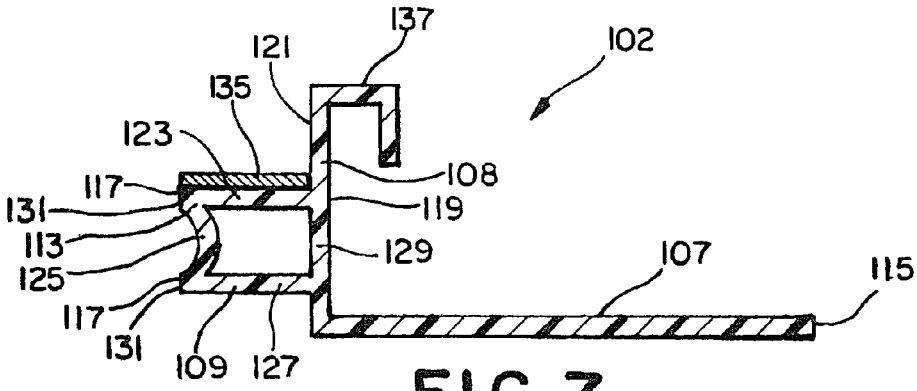
FIG. 7 is a view in cross-section of the stop bead shown in FIG. 6.
Figure 8:
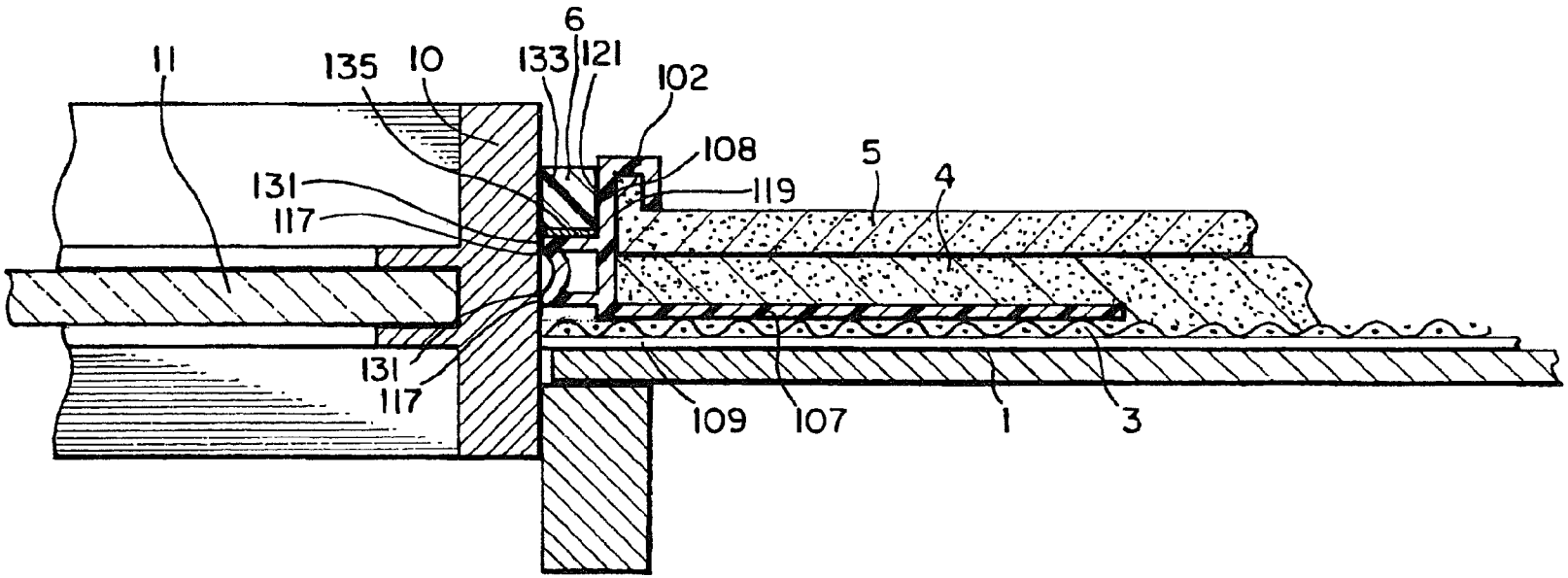
FIG. 8 is a view in cross-section showing the alternative embodiment of the stop bead of FIG. 6 installed in a wall.

Turning now to FIGS. 6 and 7, there is shown a preferred alternative embodiment of the inventive stop bead. In this preferred alternative embodiment of the invention, a stop bead 102 is provided for mounting on a wall having a jamb formed therein to separate the jamb from plaster or stucco material 4, 5 during application of the plaster or stucco material 4, 5 to the wall. The jamb is part of a frame for a window or door that frames an opening in the wall, and the jamb has a first surface facing the opening in the wall and a second surface facing away from the opening in the wall. Stop bead 102 has a first side end portion 113, and a second side end portion 115, a top end portion, and a bottom end portion 116 at the end of the stop bead 102 opposite the top end portion. The first side end portion 113 has a leading edge 117 for engaging the second surface of the jamb when the stop bead 102 is mounted adjacent to the jamb.

The stop bead 102 has a base panel 107 having a front face over which plaster or stucco material 4, 5 is applied after the stop bead 102 is mounted adjacent to the jamb. The base panel 107 preferably has perforations formed therein. A stop bead wall 108 is formed on the base panel 107 and extends outwardly above the front face of the base panel 107. The stop bead wall 108 has a first side having an engaging surface 119 for engaging plaster or stucco material 4, 5 after the stop bead 102 has been mounted adjacent to the jamb, and the stop bead wall 108 has a second side having a jamb facing surface 121 that faces the second surface of the jamb when the stop bead 102 is mounted adjacent to the jamb.

A spacing member 109 is formed on the stop bead 102 and extends outwardly away from the jamb facing surface 121 of the stop bead wall 108. The spacing member 109 preferably comprises a strip of flexible (and also preferably resilient) material (e.g., a plastic or a polymer, such as flexible vinyl (preferably a flexible exterior grade vinyl; or a metal)), and may be formed on the stop bead wall 108 by co-extruding the spacing member 109 with the remainder (which comprises a material that is compatible for co-extrusion with the material used for the spacing member 109, such as a rigid exterior grade vinyl which is compatible with a flexible exterior grade vinyl if a flexible exterior grade vinyl is used for the spacing member 109, or a rigid metal if a flexible metal compatible to the rigid metal is used for the spacing member 109) of the stop bead 102, such that the entire stop bead 102, including the spacing member 109, is extruded as one piece. Preferably, as shown in FIGS. 6 and 7, the spacing member 109 forms a hollow tube having a substantially rectangular cross-section, and four walls 123, 125, 127, and 129, with wall 129 being part of the stop bead wall 108 and walls 123, 125, and 127 being part of the spacing member 102. Preferably, wall 125 is somewhat concave.

The stop bead 102 preferably is two inches wide and about ¾ inches high (at the stop bead wall 108), and the width of the spacing member 109 (the distance between the stop bead wall 108 and the jamb when the stop bead 102 is mounted adjacent to the jamb) preferably is ¼ inch to the ½ inch and more preferably ⅜ inch. Also, the distance from the top of the spacing member 109 to the top of the stop bead wall 108 preferably is ¼ inch.

Typically, window units are vinyl or vinyl clad, or aluminum or aluminum clad, and likely to expand and contract due to changes in the weather. Further, door units often have some expansion and contraction due to changes in the weather. Because the spacing member 109 is flexible and preferably resilient, it permits movement of the jamb due to expansion or contraction of the window unit or door unit. Accordingly, if the jamb moves outwardly toward the stop bead 102 due to expansion of the window unit or the door unit it forms a part of, the jamb compresses the resilient, flexible spacing member 109 toward the stop bead wall 108, thereby accommodating for the expansion. The concave wall 125 helps facilitate the compression of the spacing member 109.

The spacing member 109 forms the leading edge 117 of the first side end portion 113 of the stop bead 102, and the leading edge 117 has a jamb engaging surface 131 that engages the second surface of the jamb when the stop bead 102 is mounted adjacent to the jamb. When the stop bead 102 is mounted adjacent to the jamb, with the jamb engaging surface 131 abutting against the second surface of the jamb, the stop bead wall 108 is spaced a uniform, predetermined distance from the second surface of the jamb. Further, the spacing member 102, in conjunction with the jamb and the jamb facing surface of the stop bead wall 108, form a caulk receiving area 133 above the spacing member 109 and between the second surface of the jamb and the jamb facing surface of the stop bead wall 108 for receiving caulk 6 to seal between the stop bead 102 and the jamb.

Preferably, bond-breaking tape 135 is fixed to the outer surface of wall 123 by laying it onto the outer surface of the wall 123 as the stop bead 102 exits the extruder. The bond-breaking tape 135 hinders formation of a bond between the caulk 6 and the bond-breaking tape 135. Accordingly, the caulk 6 positioned in the caulk receiving area 133 bonds only with the jamb and the jamb facing surface of the stop bead wall 108, thereby creating a double-sided joint (e.g., caulk 6 connected to the jamb and the jamb facing surface of the stop bead wall 108), rather than a triple-sided joint (e.g., caulk 6 connected to the jamb, the jamb facing surface of the stop bead wall 108, and the spacing member 109), to seal between the stop bead 102 and the jamb.

In addition to providing means for spacing the stop bead wall 108 a uniform and predetermined distance from the second surface of the jamb when the stop bead 102 is mounted adjacent to the jamb, and to creating a caulk receiving area 133 in conjunction with the jamb and the jamb facing surface 121 of the stop bead wall 108 when the stop bead 102 is mounted adjacent to the jamb, the spacing member 109 provides means for accommodating movement of the jamb due to expansion or contraction of the window unit or door unit, of which the jamb is a part, due to changes in the weather.

To assist in containing the plaster or stucco material 4, 5, the stop bead wall 108 has a flange 137 formed in its upper end portion, having a first portion that extends laterally away from the stop bead wall 108 and over the base panel 107 and a second portion extending from the first portion downwardly toward the base panel 107.

My invention also includes a wall having (1) a jamb formed therein, the jamb being part of a frame that frames an opening in the wall, and the jamb having a first surface facing the opening in the wall and a second surface facing away from the opening in the wall, and (2) a stop bead 102 mounted on the wall, with the spacing member 109 abutting against the second surface of the jamb, caulk 6 positioned in the caulk receiving area 133 and contacting the stop bead 102 and the jamb to form a seal between the stop bead 102 and the jamb, and a plaster or stucco material applied to the wall and separated from the jamb by the stop bead 102. Preferably, the stop bead 102 is provided with bond-breaking tape 135 mounted on the wall 123 of the spacing member 109.

In use, the inventive stop bead 102 is mounted adjacent to the jamb such that the spacing member 109 abuts against the second surface of the jamb to create a straight and uniform gap between the jamb facing surface of the stop bead wall 108 and the jamb, thereby, uniformly spacing the stop bead wall 108 from the second surface of the jamb and forming the caulk receiving area 133 for receiving caulk 6 to seal between the stop bead 102 and the jamb. To seal against leaks between the stop bead 102 and the jamb, caulk 6 is applied to and extends between the stop bead 102 and the jamb in the caulk receiving area 133 to form a seal between the stop bead 102 and the jamb. Plaster or stucco material 4, 5 is applied to the wall and kept separated from the jamb by the stop bead wall 108.

The invention provides uniform spacing of a stop bead wall from the second surface of the jamb, since the stop bead wall 108 of the stop bead 102 is spaced a uniform, predetermined distance (the width of the spacing member 109) from the jamb. The stop bead 102 separates the jamb from the plaster or stucco material being applied to the wall by blocking access to the jamb with its stop bead wall 108. The stop bead 102 also provides for sealing against leaks between the stop bead 102 and the jamb by permitting simply caulking to obtain a seal between the stop bead 102 and the jamb.

For illustrative purposes, the specification set out above uses the inventive stop bead in conjunction with a jamb of a window unit or door unit. However, the inventive stop bead may be used to separate plaster or stucco material from any material dissimilar from the plaster or stucco material, such as where plaster or stucco is to be separated from soffits, capping, or siding. As used herein, a jamb is part of a frame that frames an opening in a wall. Further, as used herein, a jamb includes a structure, such as soffits, capping, or siding, which is to be separated from plaster or stucco material with a stop bead.

What is claimed is:

1. A wall, the wall having a jamb formed therein, the jamb being part of a frame that frames an opening in the wall, and the jamb having a first surface facing the opening in the wall and a second surface facing away from the opening in the wall, a stop bead mounted on the wall against the second surface of the jamb to separate the jamb from plaster or stucco material during application of the plaster or stucco material to the wall, the stop bead comprising a first side end portion and a second side end portion, the first side end portion having a leading edge engaging the second surface of the jamb when the stop bead is mounted adjacent to the jamb, a base panel having a front face, a stop bead wall formed on the base panel and extending outwardly above the front face of the base panel, the stop bead wall having a first side and a second side, the first side of the stop bead wall having an engaging surface for engaging plaster or stucco material, and the second side of the stop bead wall having a jamb facing surface that faces the second surface of the jamb when the stop bead is mounted adjacent to the jamb, and a spacing member formed on the stop bead and extending outwardly away from the jamb facing surface of the stop bead wall spacing the stop bead wall a predetermined distance from the second surface of the jamb when the stop bead is mounted adjacent to the jamb, the spacing member forming the leading edge of the first side end portion of the stop bead, the leading edge having a jamb engaging surface engaging the second surface of the jamb when the stop bead is mounted adjacent to the jamb, and the spacing member in conjunction with the jamb and the jamb facing surface of the stop bead wall forming a caulk receiving area above the spacing member and between the second surface of the jamb and the jamb facing surface of the stop bead wall for receiving caulk to seal between the stop bead and the jamb, caulk positioned in the caulk receiving area and contacting the stop bead and the jamb to form a seal between the stop bead and the jamb, and plaster or stucco material applied to the wall and separated from the jamb by the stop bead, the spacing member comprising flexible material and being adapted to permit movement of the spacing member responsive to weather induced movement of the jamb after the stop bead is mounted adjacent to the jamb, and the spacing member being resilient.

2. The wall of claim 1, the caulk positioned in the caulk receiving area contacting the second surface of the jamb and the jamb facing surface of the stop bead wall to form the seal between the stop bead and the jamb.

3. The wall of claim 1, the caulk positioned in the caulk receiving area contacting the jamb and the jamb facing surface of the stop bead wall to form a seal between the stop bead and the jamb.

4. The wall of claim 1, the spacing member having an upper end portion having an outer surface, and further including bond-breaking tape mounted on the outer surface of the upper end portion of the spacing member for hindering formation of a bond between the caulk and the bond-breaking tape.

5. The wall of claim 1, the base panel having perforations formed therein.

6. The wall of claim 1, the stop bead having a first height at the spacing member, and the stop bead having a second height at the base panel between the stop bead wall and the second side end portion, the first height being higher than the second height.

7. The wall of claim 1, the stop bead having a height at the spacing member, and the stop bead having a height at the stop bead wall, the height of the stop bead at the stop bead wall being higher than the height of the stop bead at the spacing member.

8. The wall of claim 1, the stop bead having a first end portion and a second end portion, and the spacing member being a strip formed on the stop bead adjacent to the jamb facing surface of the stop bead wall and extending between the first end portion and the second end portion.

9. The wall of claim 1, the stop bead wall having an upper end portion, and the stop bead wall having a flange formed in its upper end portion to assist in containing plaster or stucco, the flange having a first portion that extends laterally away from the stop bead wall and over the base panel and a second portion extending from the first portion downwardly toward the base panel.

10. A stop bead for mounting on a wall having a jamb formed therein, the jamb being part of a frame that frames an opening in the wall, the jamb having a first surface facing the opening in the wall and a second surface facing away from the opening in the wall, to separate the jamb from plaster or stucco material during application of plaster or stucco material to the wall, comprising a first side end and a second side end, the first side end of the stop bead having a leading edge for engaging the second surface of the jamb when the stop bead is mounted adjacent to the jamb, a base panel having a front face and a bottom face, the bottom face of the base panel being adapted to be mounted against a wall, the stop bead having a highest point and a lowest point, the bottom face of the base panel defining the lowest point of the stop bead, a stop bead wall formed on the base panel and extending outwardly above the front face of the base panel, the stop bead wall having a first side and a second side, the first side of the stop bead wall having an engaging surface for engaging plaster or stucco material, and the second side of the stop bead wall having a jamb facing surface that faces the second surface of the jamb when the stop bead is mounted adjacent to the jamb, and a spacing member formed on the stop bead and extending outwardly away from the jamb facing surface of the stop bead wall spacing the stop bead wall a predetermined distance from the second surface of the jamb when the stop bead is mounted adjacent to the jamb, the spacing member forming the leading edge of the first side end of the stop bead, the leading edge of the first side end of the stop bead defining a point beyond which no other portion of the stop bead extends laterally in a direction extending from the second side of the stop bead wall toward the first side end of the stop bead, the leading edge having a jamb engaging surface engaging the second surface of the jamb when the stop bead is mounted adjacent to the jamb, the spacing member having an upper end portion having an outer surface, the outer surface of the upper end portion of the spacing member being substantially higher than the front face of the base panel, the spacing member forming a caulk receiving area for receiving caulk to seal between the stop bead and the jamb, the caulk receiving area being located above the outer surface of the upper end portion of the spacing member, with the outer surface of the upper end portion of the spacing member defining a bottom end of the caulk receiving area, the caulk receiving area being sized to be substantially filled by a thin application of caulk to seal between the stop bead and the jamb, and the caulk receiving area being open from above to permit access to the caulk receiving area from above to permit caulk to be applied in the caulk receiving area from above to seal between the stop bead and the jamb, and the spacing member comprising flexible material and being adapted to contract inwardly towards and expand outwardly from the stop bead wall responsive to weather induced movement of the jamb after the stop bead is mounted adjacent to the jamb, and the spacing member being resilient.

11. The stop bead of claim 10, the stop bead having a first end portion and a second end portion, and the spacing member being a strip formed on the stop bead adjacent to the jamb facing surface of the stop bead wall and extending between the first end portion and the second end portion.

12. The stop bead of claim 10, the stop bead wall having an upper end portion, and the stop bead wall having a flange formed in its upper end portion to assist in containing plaster or stucco, the flange having a first portion that extends laterally away from the stop bead wall and over the base panel and a second portion extending from the first portion downwardly toward the base panel.

13. The stop bead of claim 10, the base panel having perforations formed therein.

14. The stop bead of claim 10, the stop bead having a first height at the spacing member, and the stop bead having a second height at the base panel between the stop bead wall and the second side end portion, the first height being higher than the second height.

15. The stop bead of claim 10, the stop bead having a height at the spacing member, and the stop bead having a height at the stop bead wall, the height of the stop bead at the stop bead wall being higher than the height of the stop bead at the spacing member.

16. A method of uniformly spacing a stop bead wall from a second surface of a jamb formed in a wall, the jamb being part of a frame that frames an opening in the wall, the jamb having a first surface facing the opening in the wall, and the jamb having the second surface facing away from the opening in the wall, for separating the jamb from plaster or stucco material being applied to the wall, and for sealing against leaks between the stop bead and the jamb, comprising the steps of providing a stop bead for mounting on a wall having a jamb formed therein, the jamb being part of a frame that frames an opening in the wall, the jamb having a first surface facing the opening in the wall and a second surface facing away from the opening in the wall, to separate the jamb from plaster or stucco material during application of plaster or stucco material to the wall, comprising a first side end and a second side end, the first side end of the stop bead having a leading edge for engaging the second surface of the jamb when the stop bead is mounted adjacent to the jamb, a base panel having a front face and a bottom face, the bottom face of the base panel being adapted to be mounted against a wall, the stop bead having a highest point and a lowest point, the bottom face of the base panel defining the lowest point of the stop bead, a stop bead wall formed on the base panel and extending outwardly above the front face of the base panel, the stop bead wall having a first side and a second side, the first side of the stop bead wall having an engaging surface for engaging plaster or stucco material, and the second side of the stop bead wall having a jamb facing surface that faces the second surface of the jamb when the stop bead is mounted adjacent to the jamb, and a spacing member formed on the stop bead and extending outwardly away from the jamb facing surface of the stop bead wall spacing the stop bead wall a predetermined distance from the second surface of the jamb when the stop bead is mounted adjacent to the jamb, the spacing member forming the leading edge of the first side end of the stop bead, the leading edge of the first side end of the stop bead defining a point beyond which no other portion of the stop bead extends laterally in a direction extending from the second side of the stop bead wall toward the first side end of the stop bead, the leading edge having a jamb engaging surface engaging the second surface of the jamb when the stop bead is mounted adjacent to the jamb, the spacing member having an upper end portion having an outer surface, the outer surface of the upper end portion of the spacing member being substantially higher than the front face of the base panel, the spacing member forming a caulk receiving area for receiving caulk to seal between the stop bead and the jamb, the caulk receiving area being located above the outer surface of the upper end portion of the spacing member, with the outer surface of the upper end portion of the spacing member defining a bottom end of the caulk receiving area, the caulk receiving area being sized to be substantially filled by a thin application of caulk to seal between the stop bead and the jamb, and the caulk receiving area being open from above to permit access to the caulk receiving area from above to permit caulk to be applied in the caulk receiving area from above to seal between the stop bead and the jamb, and the spacing member comprising flexible material and being adapted to contract inwardly towards and expand outwardly from the stop bead wall responsive to weather induced movement of the jamb after the stop bead is mounted adjacent to the jamb, and the spacing member being resilient, mounting the stop bead adjacent to the jamb such that the spacing member abuts the second surface of the jamb to create a straight and uniform gap between the jamb facing surface of the stop bead wall and the jamb, thereby uniformly spacing the stop bead wall from the second surface of the jamb and forming the caulk receiving area for receiving caulk to seal between the stop bead and the jamb, sealing against leaks between the stop bead and the jamb by applying caulk to and extending between the stop bead and the jamb in the caulk receiving area to form a seal between the stop bead and the jamb, and applying plaster or stucco material to the wall and keeping the plaster or stucco material separated from the jamb by the stop bead wall.

17. The method of claim 16, the caulk positioned in the caulk receiving area contacting the second surface of the jamb and the jamb facing surface of the stop bead wall to form the seal between the stop bead and the jamb.

18. The method of claim 16, the caulk positioned in the caulk receiving area contacting the jamb and the jamb facing surface of the stop bead wall to form a seal between the stop bead and the jamb.

19. The method of claim 16, the spacing member having an upper end portion having an outer surface, and further including bond-breaking tape mounted on the outer surface of the upper end portion of the spacing member for hindering formation of a bond between the caulk and the bond-breaking tape.

20. A stop bead for mounting on a wall having a jamb formed therein, the jamb being part of a frame that frames an opening in the wall, the jamb having a first surface facing the opening in the wall and a second surface facing away from the opening in the wall, to separate the jamb from plaster or stucco material during application of plaster or stucco material to the wall, comprising a first side end and a second side end, the first side end of the stop bead having a leading edge for engaging the second surface of the jamb when the stop bead is mounted adjacent to the jamb, a base panel having a front face and a bottom face, the bottom face of the base panel being adapted to be mounted against a wall, the stop bead having a highest point and a lowest point, the bottom face of the base panel defining the lowest point of the stop bead, a stop bead wall formed on the base panel and extending outwardly above the front face of the base panel, the stop bead wall having a first side and a second side, the first side of the stop bead wall having an engaging surface for engaging plaster or stucco material, and the second side of the stop bead wall having a jamb facing surface that faces the second surface of the jamb when the stop bead is mounted adjacent to the jamb, and a spacing member formed on the stop bead and extending outwardly away from the jamb facing surface of the stop bead wall spacing the stop bead wall a predetermined distance from the second surface of the jamb when the stop bead is mounted adjacent to the jamb, the spacing member forming the leading edge of the first side end of the stop bead, the leading edge of the first side end of the stop bead defining a point beyond which no other portion of the stop bead extends laterally in a direction extending from the second side of the stop bead wall toward the first side end of the stop bead, the leading edge having a jamb engaging surface engaging the second surface of the jamb when the stop bead is mounted adjacent to the jamb, the spacing member having an upper end portion having an outer surface, the outer surface of the upper end portion of the spacing member being higher than the front face of the base panel, the spacing member forming a caulk receiving area for receiving caulk to seal between the stop bead and the jamb, the caulk receiving area being located above the outer surface of the upper end portion of the spacing member, with the outer surface of the upper end portion of the spacing member defining a bottom end of the caulk receiving area, the caulk receiving area being open from above to permit access to the caulk receiving area from above to permit caulk to be applied in the caulk receiving area from above to seal between the stop bead and the jamb, and the spacing member being adapted to contract inwardly towards and expand outwardly from the stop bead wall responsive to weather induced movement of the jamb after the stop bead is mounted adjacent to the jamb, the spacing member having an upper end portion having an outer surface, and further including bond-breaking tape mounted on the outer surface of the upper end portion of the spacing member for hindering formation of a bond between the caulk and the bond-breaking tape.

21. The stop bead of claim 20, the spacing member being resilient.

22. A stop bead for mounting on a wall having a jamb formed therein, the jamb being part of a frame that frames an opening in a wall, the jamb having a first surface facing the opening in the wall and a second surface facing away from the opening in the wall, to separate the jamb from plaster or stucco material during application of the plaster or stucco material to the wall, comprising:

a first side end and a second side end, the first side end of the stop bead having a leading edge for engaging the second surface of the jamb when the stop bead is mounted adjacent to the jamb, a base panel having a front face and a bottom face, the bottom face being adapted to be mounted against a wall, the stop bead having a highest point and a lowest point, the bottom face of the base panel defining the lowest point of the stop bead, a stop bead wall formed on the base panel and extending outwardly above the front face of the base panel, and first means formed on the stop bead for contacting the jamb when the stop bead is mounted adjacent to the jamb, for spacing the stop bead wall a predetermined distance from the jamb when the stop bead is mounted adjacent to the jamb, and for receiving caulk to seal between the stop bead and the jamb when the stop bead is mounted adjacent to the jamb, said first means forming the leading edge of the first side end of the stop bead, the leading edge of the first side end of the stop bead defining a point beyond which no portion of the stop bead extends laterally in a direction extending from the stop bead wall toward the first side end of the stop bead, said first means having an upper end portion having an outer surface, the outer surface of the upper end portion of said first means being higher than the front face of the base panel, said first means including a caulk receiving area for receiving caulk to seal between the stop bead and the jamb, the caulk receiving area being located above the outer surface of the upper end portion of said first means, with the outer surface of the upper end portion of said first means defining a bottom end of the caulk receiving area, the caulk receiving area being open from above to permit access to the caulk receiving area from above to permit caulk to be applied in the caulk receiving area from above to seal between the stop bead and the jamb, and said first means having expansion/contraction means for permitting said first means to expand outwardly from and to contract inwardly towards the stop bead wall responsive to weather induced movement of the jamb after the stop bead is mounted adjacent to the jamb, and said first means being resilient.

23. The stop bead of claim 22, further including bond-breaking tape mounted on the outer surface of the upper end portion of the spacing member for hindering formation of a bond between the caulk and the bond-breaking tape.

24. A stop bead for mounting on a wall having a jamb formed therein, the jamb being part of a frame that frames an opening in the wall, the jamb having a first surface facing the opening in the wall and a second surface facing away from the opening in the wall, to separate the jamb from plaster or stucco material during application of plaster or stucco material to the wall, comprising a first side end and a second side end, the first side end of the stop bead having a leading edge for engaging the second surface of the jamb when the stop bead is mounted adjacent to the jamb, a base panel having a front face and a bottom face, the bottom face of the base panel being adapted to be mounted against a wall, the stop bead having a highest point and a lowest point, the bottom face of the base panel defining the lowest point of the stop bead, a stop bead wall formed on the base panel and extending outwardly above the front face of the base panel, the stop bead wall having a first side and a second side, the first side of the stop bead wall having an engaging surface for engaging plaster or stucco material, and the second side of the stop bead wall having a jamb facing surface that faces the second surface of the jamb when the stop bead is mounted adjacent to the jamb, and a spacing member formed on the stop bead and extending outwardly away from the jamb facing surface of the stop bead wall spacing the stop bead wall a predetermined distance from the second surface of the jamb when the stop bead is mounted adjacent to the jamb, the spacing member forming the leading edge of the first side end of the stop bead, the leading edge of the first side end of the stop bead defining a point beyond which no other portion of the stop bead extends laterally in a direction extending from the second side of the stop bead wall toward the first side end of the stop bead, the leading edge having a jamb engaging surface engaging the second surface of the jamb when the stop bead is mounted adjacent to the jamb, the spacing member having an upper end portion having an outer surface, the outer surface of the upper end portion of the spacing member being substantially higher than the front face of the base panel, the spacing member forming a caulk receiving area for receiving caulk to seal between the stop bead and the jamb, the caulk receiving area being located above the outer surface of the upper end portion of the spacing member, with the outer surface of the upper end portion of the spacing member defining a bottom end of the caulk receiving area, the caulk receiving area being sized to be substantially filled by a thin application of caulk to seal between the stop bead and the jamb, and the caulk receiving area being open from above to permit access to the caulk receiving area from above to permit caulk to be applied in the caulk receiving area from above to seal between the stop bead and the jamb, and the spacing member comprising flexible material and being adapted to contract inwardly towards and expand outwardly from the stop bead wall responsive to weather induced movement of the jamb after the stop bead is mounted adjacent to the jamb, the spacing member being resilient, and the spacing member having an upper wall having a distal end, a lower wall having a distal end, an outer side wall extending between the distal ends of the upper wall and the lower wall of the spacing member, and the upper wall, the lower wall, and the outer side wall of the spacing member forming in conjunction with the stop bead wall a flexible hollow tube which flexes to accommodate expansion and contraction of the jamb due to changes in weather after the stop bead is mounted adjacent to the jamb.

25. The stop bead of claim 24, the outer side wall extending between the distal ends of the upper wall and the lower wall of the spacing member being concave.

* * * * *